United States Patent [19]

Schwarz

[11] 4,323,235

[45] Apr. 6, 1982

[54] PHYSICAL TRAINING APPARATUS FOR HOLDING A PERSON'S FEET WHEN PERFORMING SIT-UPS

[76] Inventor: Gu ter Schwarz, Steinacherstr. 67, CH-8804 Au ZH, Switzerland

[21] Appl. No.: 210,291

[22] Filed: Nov. 25, 1980

[30] Foreign Application Priority Data

Feb. 14, 1980 [CH] Switzerland ..... 1189/80

[51] Int. Cl.[3] ..... A63B 23/02

[52] U.S. Cl. ..... 272/93; 272/900; 248/114

[58] Field of Search ..... 272/900, 93, 143, 145, 272/125, DIG. 5

[56] References Cited

U.S. PATENT DOCUMENTS

| | | | |
|---|---|---|---|
| 1,905,019 | 4/1933 | Turner | 272/900 |
| 2,050,652 | 8/1936 | Fleming | 272/93 |
| 2,425,971 | 8/1947 | Walker | 272/900 |
| 3,430,953 | 3/1969 | Teetor | 272/900 X |
| 4,176,835 | 12/1979 | Aziz | 272/93 |
| 4,182,509 | 1/1980 | Chupp | 272/900 |
| 4,182,510 | 1/1980 | Lundell | 272/900 |
| 4,185,816 | 1/1980 | Bernstein | 272/900 |

*Primary Examiner*—Richard J. Johnson

*Attorney, Agent, or Firm*—Toren, McGeady & Stanger

[57] ABSTRACT

Physical training apparatus for holding a person's feet while the person lies supine on a floor with his or her feet facing a closed door, includes a generally trapezoidally shaped foot bar support member which has a base portion with a planar bottom surface facing toward the floor. The support member also has a first surface which extends normal to the floor and faces toward the person, and a second surface which is inclined upwardly from the base portion toward the first surface and which faces toward the door. An extension member extends from the base portion toward the door to pass through an opening between the door and the floor, and to engage the door so as to prevent the bar support member from moving away from the door. A wedge-like space is thereby formed between the bar support member and the door, and a locking wedge is provided for insertion in the wedge-like space to fix the bar support member against movement toward the door. Accordingly, the apparatus dispenses with the need for another person to hold the feet of the person when performing sit-ups.

14 Claims, 7 Drawing Figures

PHYSICAL TRAINING APPARATUS FOR HOLDING A PERSON'S FEET WHEN PERFORMING SIT-UPS

BACKGROUND OF THE INVENTION

The present invention relates to physical training apparatus which holds the feet of a person while the person is lying on a floor and repeatedly bending at his or her trunk, i.e. performing sit-ups.

The apparatus of the invention is of a light-weight construction and relatively small size, and is particularly suited for use in the home as it can be easily attached to and thereafter removed from a stationary object, e.g., a closed door.

When performing sit-ups for exercising the stomach muscles, it often has been necessary for a second person to hold the feet of the person exercising on the floor. Otherwise, common gymnasium apparatus, i.e., wall bars, were necessary wherein the person's feet were placed under the lowermost bar.

The above disadvantages are solved by the present invention which comprises a bar support member including a base portion, a first surface which extends upwardly from a floor on which a person is lying with the person's feet facing a door, and a second surface which is inclined upwardly from the base portion toward the first surface and which faces the door. Means on the bar support member are provided to enable at least one bar to be inserted in the member for engaging the person's feet, and an extension member extends from the base portion to pass through an opening between the bottom of the door and the floor to engage the door and prevent movement of the bar support member away from the door. A locking member is insertable in a wedge-like space formed between the bar support member and the door to fix the bar support member against movement toward the door.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
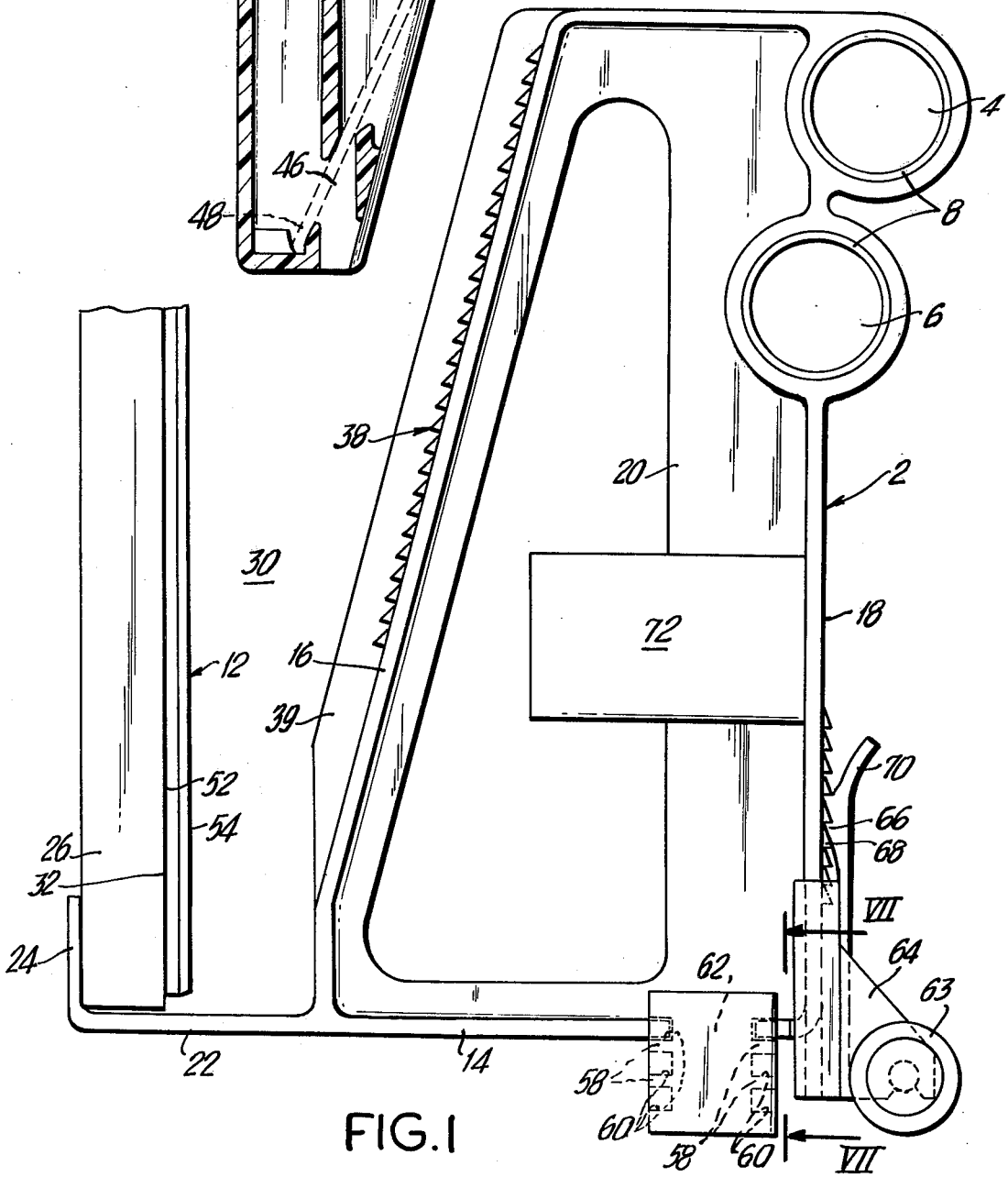
FIG. 1 is an elevational view of the bar support member engaging a door on which a pressure plate is provided.

In FIG. 1, a bar support member 2 of generally trapezoidal shape is shown. The bar support member 2 has one surface 18 which faces a person's feet (not shown) while the person lies on a floor (not shown) and uses the present apparatus to perform sit-ups with his or her feet facing a door 26 held in a stationary position. The surface 18 extends vertically, assuming the floor is horizontal. Cylindrical openings 4,6 are formed by sleeve-like walls in the bar support member 2. These openings are arranged in the vicinity of the surface 18 of the bar support member, and extend substantially parallel to surface 18 and to the floor. Each of the openings 4,6 is arranged to receive a horizontally extending foot support bar (not shown) from the direction in which the bar support member 2 is viewed in FIG. 1, and to receive another horizontal foot support bar (also not shown) which is inserted into that opening from the opposite direction from that in which the bar support member 2 is viewed in FIG. 1.

An annular shoulder 8 on the inner circumference of the sleeve-like walls forms an inner boundary mid-way through each of the openings 4,6, the shoulder 8 providing an inner abutment against which the foot support bars are seated when the bars are inserted into the openings 4,6 of the bar support member 2.

Bar support member 2 also includes a base portion 14 having a generally planar bottom surface which extends horizontally, i.e., parallel to the floor. The bar support member 2 also has a surface 16 which faces toward the door 26, and extends in a plane which is inclined upwardly from the base portion 14 in the direction toward the surface 18 so as to form an acute angle with a line (not shown) which extends normal to the bottom surface of the base portion 14.

A plate-like extension member 22 extends from the base portion 14 of the bar support member 2, horizontally from the surface 16 toward the door 26 and within the plane of the bottom surface of the base portion. A wall portion 24 projects up from the free end of the extension member 22 to engage the rear surface of a door 26 after the extension member 22 has been slid under the door 26 while the door is open, with the bar support member 2 facing the front surface 32 of the door 26. Extension member 22 is of sufficient length to accommodate doors of various thicknesses. Once the door 26 is closed, the wall portion 24 will prevent movement of the support member 2 in the direction away from the door 26 after the wall portion 24 contact the door.

The bar support member 2 of FIG. 1, can be, like most of the parts of the present apparatus, made from a plastics material. The material is formed into walls of about, for example, 3 mm thickness. These walls are reinforced by a rib 20 which extends entirely around the inner periphery of the walls and normal to them. This arrangement imparts sufficient rigidity to the bar support member 2 notwithstanding its relatively light weight.

Figure 2:
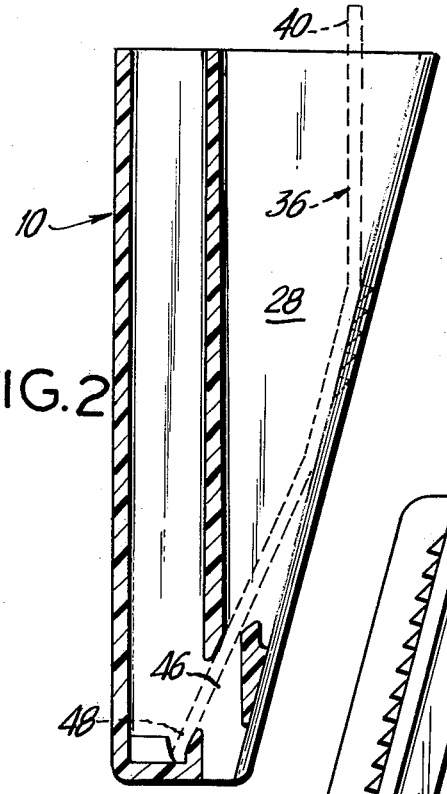
FIG. 2 is a cross-sectional view of the locking member taken along line II—II in FIG. 4.
Figure 4:
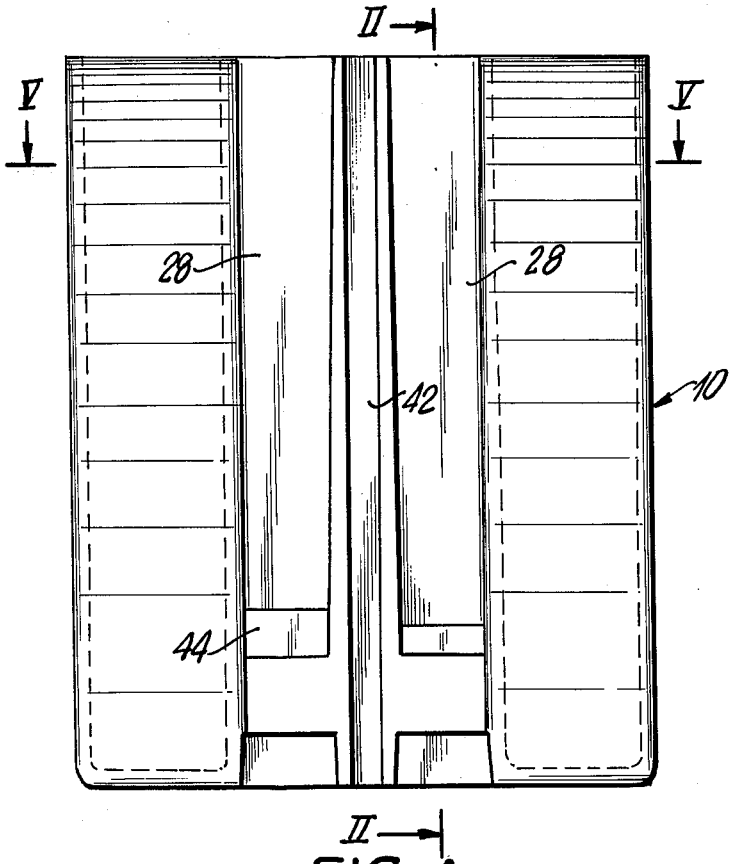
FIG. 4 is a view of the right side of the locking member as viewed in FIG. 2.

Regarding the foot support bars (not shown), they may each project out from the openings 4,6 parallel to the bottom surface of the base portion 14 over a distance of, for example, 120 mm. The foot support bars inserted into the openings 6 may be at a height of, for example, 130 mm above the bottom surface of the base portion 14, and the bars extending from the openings 4 may be at a height of, for example, 160 mm above the bottom surface. Accordingly, bars can be inserted in either pair of openings 4,6 to accommodate different foot sizes. In order to fix the bar support member 2 against movement toward the door 26, a locking member or wedge 10 is provided, the locking member being shown in FIGS. 2, 4 and 5. The locking member is arranged to operate with doors of various thicknesses, and it is preferred that a pressure plate 12 (FIG. 1) be provided on the door surface 32 which faces the bar support member 2, the pressure plate 12 contacting the locking member 10 when the locking member 10 is in a locking position.

Locking member 10 is inserted into a wedge-like space 30 which is formed between the pressure plate 12 on the front surface 32 of the door 26, and the inclined surface 16 of the bar support member 2. When urged downwardly into the space 30, the portion of the locking member 10 which contacts the surface 16 of the bar support member positively engages the bar support member.

The overall width of the bar support member 2, locking member 10 and pressure plate 12 are all about equal to one another.

Figure 3:
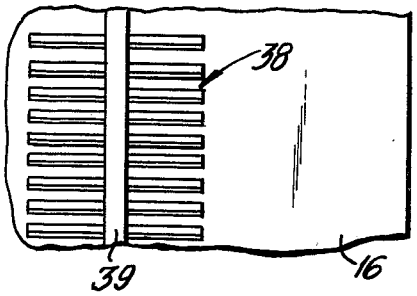
FIG. 3 is a partial view of two parallel rows of notches arranged on the inclined surface of the bar support member in FIG. 1.
Figure 6:
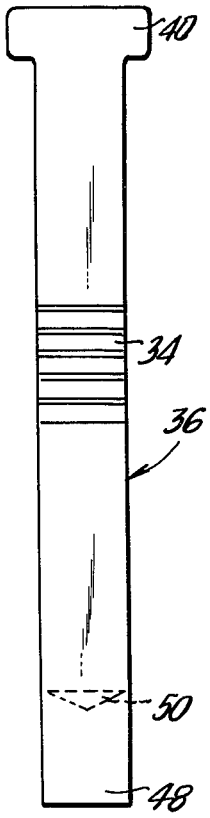
FIG. 6 is a view of a resilient tongue member which is insertable in the locking member.

As shown in FIG. 3, two parallel rows of notches 38 are each arranged on a different side of a guide rib 39 which projects normally to the inclined surface 16 of the bar support member 2 (see FIG. 1). These notches 38 engage corresponding notches 34 provided in a pair of resilient tongue members 36 arranged in the locking member 10. One of the tongue members 36 with its associated notches 34 is shown in FIG. 6.

In order that the locking member 10 can be removed from its locking position when the apparatus is to be removed from the door 26, the free upper end 40 of the resilient tongue member 36 is arranged to be easily gripped by hand to allow the notches 34 thereon to be manually disengaged from the notches 38 on the inclined surface 16 of the bar support member 2. As indicated by broken lines in FIG. 2, the resilient tongue member 36 is generally bow-shaped, when inserted in the locking member 10, with the notches 34 thereon being located on the central bulging portion of the tongue member 36.

Figure 5:
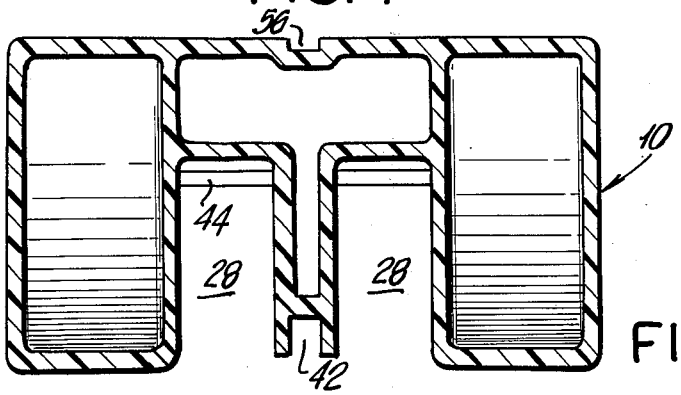
FIG. 5 is a partly sectional view of the locking member as taken along line V—V in FIG. 4.

As shown in FIG. 5, locking member 10 has a guide slot 42 for receiving the guide rib 39 extending from the bar support member 2 and guiding the movement of the locking member 10 while it is placed in the locking position. A parallel pair of channel-like recesses 28 are formed in the locking member 10, each recess 28 being located on a different side of the guide slot 42 and being of sufficient width to receive one of the tongue members 36. Each of the recesses 28, in the lower portion of the locking member 10, includes a locking web 44 which engages the lower end 48 of the tongue member 36 after the end 48 is inserted through an opening 46 (FIG. 2) formed at the bottom of each recess 28. The lower end 48 of the tongue member 36 may have a thickened portion 50 (FIG. 6) to ensure secure engagement with the lower portion of the locking member 10. As with the bar support member 2, the locking member 10 can be constructed of a plastics material which forms relatively thin walls having open interior regions.

As shown in FIG. 5, the locking member 10 has another guide slot 56 which engages a corresponding guide rib 54 on the door pressure plate 12, rib 54 extending in a direction normal to the floor. This will ensure that the pressure plate 12 assumes a correct position relative to the confronting surface of the locking member 10 when the latter is brought to its locking position. The pressure plate 12 may be permanently fixed to the door 26 by way of an adhesive layer 52 of, for example, soft rubber which provides good adhesion without damaging the door surface 32. An adhesive layer can also be provided on the side of the hook-like wall portion 24 which is pressed against the rear surface of the door 26, when the locking member 10 is brought to the locking position.

Figure 7:
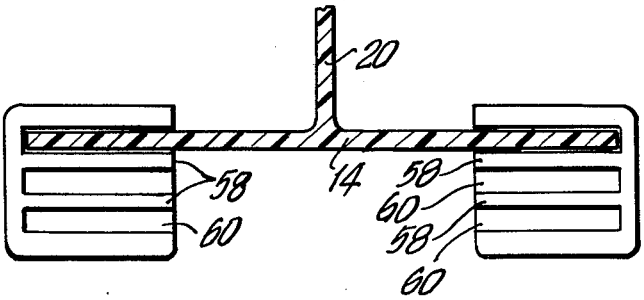
FIG. 7 is a partial sectional view of the bar support member as taken along line VII—VII in FIG. 1.

The bar support member 2 is also urged in the direction toward the floor, at its end further from the door, in response to the wedging action of the locking member 10. Since the lower edge of the door 26 and, hence, the extension member 22, may be at a relatively large distance above the floor, vertically adjustable feet 58 can be attached to the base portion 14 of the bar support member 2 in order to maintain the bottom surface of the base portion 14 parallel to the floor, as shown in FIGS. 1 and 7. The feet 58 may be, for example, in the shape of a cube and arranged at both sides of the rib 20 of the bar support member 2. Each foot 58 has a number of grooves 60, each groove 60 extending to the side of the foot which faces the rib 20. The height of each slot 60 corresponds to the thickness of the wall forming the portion 14 of the bar support member 2. Two outwardly open cutouts 62 for receiving the feet 58 are provided in this wall on each side of the rib 20. In the vicinity of the cutouts 62, the base portion wall can have thickened portions (not shown) and the thickened surfaces of the cutouts which contact the feet 58 can have a number of grooves or slots therein for selectively engaging several of a number of grooves on the sides of the feet 58 (not shown), so that precise positional adjustment of the feet 58 relative to the bar support member 2 is then possible.

In place of the feet 58, balls or rollers 63 can be used as shown in FIG. 1. This arrangement provides the advantage that the door 26 can then be opened notwithstanding the attachment of the present apparatus to the door 26. In this case, it is desirable that the outer surfaces of the apparatus be such that no damage occurs in the event the apparatus strikes a wall or furniture upon further opening of the door. One or more rubber members can be provided on the apparatus to achieve this result.

Rollers 63 can be mounted on a slide member 64, the latter being arranged for movement along the vertical surface 18 of the bar support member 2. The slide member 64 is selectively fixed at one of a number of different heights by way of notches 66 which engage corresponding notches 68 on the vertical surface 18. The slide member 64 may be provided with a resilient tongue portion 70 in which the notches 66 are formed. Although FIG. 1 shows both a foot 58 and a roller 63, usually only the feet 58, or the rollers 63, described above, are used. Further, the bottom surfaces of the feet 58 can be rounded to such an extent, e.g., hemispherically, so that they produce relatively slight friction with the floor surface and provide a result comparable to that obtained with the rollers 63.

As an additional feature, an alarm clock 72 (FIG. 1) can be mounted in the bar support member 2, since the present apparatus will ordinarily be used soon after awakening.

While specific embodiments of the invention have been shown and described in detail to illustrate the application of the inventive principles, it will be understood that the invention may be embodied otherwise without departing from such principles.

What is claimed is:

1. Physical training apparatus for holding a person's feet while the person lies on a horizontal floor to perform sit-ups and the feet are facing a closed, vertically extending door which forms an elongated opening between the bottom surface of the door and the floor, the apparatus being arranged to be fixed to the door, comprising a bar support member including a base portion which has a generally planar horizontal bottom surface to face the floor, said bar support member also having a first surface which extends vertically from the base portion and a second surface which is upwardly inclined from said base portion and converges toward said first surface to define an acute angle with a vertically extending line and to form a wedge-like space between said bar support member and the upwardly extending surface of the door, means on said bar support member for enabling at least one horizontally extending bar to be inserted in said bar support member to engage a person's feet, extension means extending horizontally from said second surface parallel to said bottom surface to pass through the opening between the door and the floor to engage the door for preventing movement of said bar support member in the direction away from the door, and a locking member for insertion in the wedge-like space to engage said second surface of said bar support member to fix the bar support member against movement in the direction toward the door when said locking member is at a locking position.

2. Physical training apparatus according to claim 1, wherein said locking member is generally wedge-shaped and has a wedging surface for contacting said second surface of said bar support member when said locking member is in the locking position.

3. Physical training apparatus according to claim 2, wherein said second surface on said support member has at least one row of notches, and including at least one resilient tongue member having means thereon for engaging the notches on said bar support member, and said locking member is arranged so that said tongue member is detachably mounted to said locking member.

4. Physical training apparatus according to claim 2, including means for guiding movement of said locking member against said bar support member as said locking member is moved to the locking position.

5. Physical training apparatus according to claim 4, wherein said guiding means includes a guide rib extending along said second surface of said bar support member in a plane normal to said bottom surface of said base portion, and said locking member has a guide slot in said wedging surface for engaging said guide rib.

6. Physical training apparatus according to claim 1, including a pressure plate and an adhesive surface on one side of said pressure plate, said pressure plate being located between said locking member and the door to contact said locking member when said locking member is in the locking position and said extension means contacts the door to prevent damage to the door.

7. Physical training apparatus according to claim 3, wherein said locking member has at least one channel-like recess of a certain width which recess extends in a plane normal to the bottom surface of said bar support member, said recess opening in the direction toward said second surface of said bar support member when said locking member is moved to the locking position, said resilient tongue member has a width corresponding to said certain width of said recess, one end of said tongue member being fixed to said locking member at one end of said recess, and said engaging means includes at least one notch on the central portion of said tongue member which projects from said recess to engage said notches on said bar support member.

8. Physical training apparatus according to claim 7, wherein said locking member has two parallel channel-like recesses therein, and a resilient tongue member fixed to said locking member at one end of each of said recesses.

9. Physical training apparatus according to claim 6, wherein said pressure plate includes a guide rib operatively extending in the direction normal to the floor, and said locking member has a corresponding guide slot for engaging said guide rib on said pressure plate when said locking member is in the locking position.

10. Physical training apparatus according to claim 1, including at least one foot mounted at a certain location on said base portion of said support member and means associated with said foot for adjusting the height of said certain location from the floor to maintain said bottom surface parallel to the floor.

11. Physical training apparatus according to claim 10, wherein said base portion of said bar support member has at least one opening for receiving said foot, and said foot has a number of grooves arranged therein so that said foot can be mounted by being placed within said openings.

12. Physical training apparatus according to claim 10, wherein said foot has a bottom surface which is generally hemispherically shaped.

13. Physical training apparatus according to claim 1, including at least one roller mounted at a certain location on said base portion of said bar support member and means associated with said roller for adjusting the height of said certain location from the floor to maintain said bottom surface parallel to the floor.

14. Physical training apparatus according to claim 1, including an alarm clock fixed to said base support member for alerting the person to use the apparatus.

* * * * *

UNITED STATES PATENT OFFICE

CERTIFICATE OF CORRECTION

Patent No. 4,323,235 Dated April 6, 1982

Inventor(s) Günther Schwarz

It is certified that error appears in the above-identified patent and that said Letters Patent are hereby corrected as shown below:

In the heading of the Patent [76] should read as follows:

[76] Inventor: Günter Schwarz, Steinacherstr. 67, CH-8804 Au ZH, Switzerland

Signed and Sealed this

First Day of June 1982

[SEAL]

Attest:

GERALD J. MOSSINGHOFF

Attesting Officer

Commissioner of Patents and Trademarks